US008707563B2

(12) United States Patent
Avery

(10) Patent No.: US 8,707,563 B2
(45) Date of Patent: Apr. 29, 2014

(54) CUTTING TOOL WITH MULTIPLE SCISSORS TOOLS

(75) Inventor: Lisa A. Avery, Tinley Park, IL (US)

(73) Assignee: Limiri, LLC, Tinley Park, IL (US)

( * ) Notice: Subject to any disclaimer, the term of this patent is extended or adjusted under 35 U.S.C. 154(b) by 428 days.

(21) Appl. No.: 12/474,018

(22) Filed: May 28, 2009

(65) Prior Publication Data

US 2009/0293284 A1 Dec. 3, 2009

Related U.S. Application Data

(60) Provisional application No. 61/130,368, filed on May 30, 2008.

(51) Int. Cl.

| | |
|---|---|
| ***B26B 3/06*** | (2006.01) |
| ***F41B 13/02*** | (2006.01) |
| ***B25F 3/00*** | (2006.01) |
| ***B26B 1/00*** | (2006.01) |
| ***B26B 13/00*** | (2006.01) |
| ***B26B 11/00*** | (2006.01) |

(52) U.S. Cl.
USPC ..... 30/152; 30/155; 30/131; 30/229; 7/118

(58) Field of Classification Search
USPC ..... 30/2, 211, 229, 230, 254, 255, 152, 30/155, 279.2, 57, 29, 41.9, 226, 131, 142, 30/143, 151, 153; 7/118, 128, 131, 134, 7/135
IPC ..... B26B 13/10,13/00
See application file for complete search history.

(56) References Cited

U.S. PATENT DOCUMENTS

| | | | | | |
|---|---|---|---|---|---|
| 550,483 | A | * | 11/1895 | Carrier | 452/141 |
| 1,012,918 | A | * | 12/1911 | Roelants et al. | 30/227 |
| 1,828,121 | A | * | 10/1931 | Adam et al. | 132/75.5 |
| 2,272,580 | A | * | 2/1942 | Phillips | 30/195 |
| 2,749,924 | A | * | 6/1956 | Polincovsky | 132/76.2 |
| 4,203,208 | A | | 5/1980 | Tausendfreundt et al. | |
| 4,250,619 | A | * | 2/1981 | Buerkert et al. | 30/230 |
| 5,280,659 | A | * | 1/1994 | Park | 7/128 |
| 5,341,573 | A | * | 8/1994 | Linden et al. | 30/254 |
| 5,526,571 | A | * | 6/1996 | Linden | 30/255 |
| 5,758,422 | A | * | 6/1998 | Frank | 30/230 |
| 5,857,268 | A | | 1/1999 | Park | |
| 5,875,553 | A | * | 3/1999 | Geib et al. | 30/226 |
| 5,946,752 | A | | 9/1999 | Parrish | |

(Continued)

FOREIGN PATENT DOCUMENTS

| | | | | |
|---|---|---|---|---|
| CN | 201008281 | Y | * | 1/2008 |
| JP | 2007203003 | A | * | 8/2007 |

OTHER PUBLICATIONS

School smart paper edger scissors with Oak stand kit (Amazon.com),Jan. 1, 2008.*

(Continued)

*Primary Examiner* — Ghassem Alie
*Assistant Examiner* — Bharat C Patel
(74) *Attorney, Agent, or Firm* — Brinks Gilson & Lione

(57) ABSTRACT

A cutting tool having a body, a first scissors tool coupled with the body and having a first pair of blades cooperating to define a first cutting pattern, and a second scissors tool coupled with the body and having a second pair of blades cooperating to define a second cutting pattern.

12 Claims, 8 Drawing Sheets

(56) References Cited

U.S. PATENT DOCUMENTS

| | | | | |
|---|---|---|---|---|
| 5,950,265 | A | 9/1999 | Allen et al. | |
| 5,979,059 | A * | 11/1999 | Leatherman et al. | 30/161 |
| 5,979,959 | A | 11/1999 | Rivera | |
| 5,996,592 | A * | 12/1999 | Choy | 132/200 |
| 6,065,213 | A | 5/2000 | Rivera | |
| 6,131,223 | A * | 10/2000 | Rehkemper et al. | 7/158 |
| D433,915 | S * | 11/2000 | Elsener, Sr. | D8/105 |
| 6,220,127 | B1 | 4/2001 | Berg et al. | |
| 6,273,582 | B1 * | 8/2001 | Taggart et al. | 362/119 |
| 6,286,745 | B1 | 9/2001 | Ackeret | |
| 6,389,625 | B1 | 5/2002 | Rivera | |
| 6,389,626 | B1 * | 5/2002 | Hung | 7/128 |
| 6,457,241 | B1 * | 10/2002 | Droin | 30/232 |
| D472,124 | S | 3/2003 | Park | |
| 6,588,040 | B2 * | 7/2003 | Rivera | 7/128 |
| 6,601,481 | B2 * | 8/2003 | Chuang | 81/440 |
| 6,622,327 | B1 * | 9/2003 | Rivera | 7/128 |
| 6,622,329 | B2 * | 9/2003 | Ostor et al. | 7/138 |
| 6,698,049 | B2 * | 3/2004 | McLoudrey | 7/158 |
| 6,948,409 | B2 * | 9/2005 | Ackeret et al. | 81/440 |
| 6,957,466 | B2 | 10/2005 | Rivera | |
| 7,020,923 | B1 * | 4/2006 | Jangula | 7/166 |
| 7,032,316 | B1 * | 4/2006 | Tseng | 30/226 |
| 7,051,627 | B2 | 5/2006 | Rivera | |
| 7,140,280 | B2 * | 11/2006 | Hawkins et al. | 81/440 |
| 7,204,022 | B2 | 4/2007 | Tsuda | |
| 2003/0167573 | A1 | 9/2003 | McLoudrey | |
| 2004/0078982 | A1 * | 4/2004 | Yeh | 30/226 |
| 2005/0283981 | A1 * | 12/2005 | Yizhar | 30/142 |
| 2007/0022613 | A1 * | 2/2007 | Carpenter et al. | 30/260 |
| 2007/0022849 | A1 | 2/2007 | Poehlmann | |
| 2007/0044319 | A1 * | 3/2007 | Yeh | 30/194 |
| 2007/0294897 | A1 * | 12/2007 | Chen | 30/254 |

OTHER PUBLICATIONS

"Swiss army knife shop Switzerland MiniChamp Victorinox"; printed from the Internet at http://www.swiss-knife.com/asp/detail.asp?lan=EN&code=0.6385&shop=SK; dated Apr. 18, 2008; 1 page.

* cited by examiner

CUTTING TOOL WITH MULTIPLE SCISSORS TOOLS

CROSS-REFERENCE TO RELATED APPLICATION

This patent application claims the benefit under 35 U.S.C. §119(e) of U.S. provisional patent application Ser. No. 61/130,368, filed May 30, 2008 and entitled CUTTING TOOL WITH MULTIPLE SCISSORS TOOLS, the entire contents of which is incorporated herein by reference.

BACKGROUND OF THE INVENTION

1. Field of the Invention

The invention relates generally to a cutting tool having multiple cutting attachments. More specifically, the invention relates to a cutting tool having a body and first and second scissors tools coupled with the body, where each of the first and second scissors tools has a pair of blades defining a cutting pattern.

2. Related Technology

Scissors tools are known in the art for cutting objects such as paper. Scissors tools typically include straight blades for cutting objects in a straight pattern. However, more complex or decorative patterns may be desirable, particularly for applications such as scrapbooking applications, gift wrapping applications, and other arts and crafts applications. For some applications or projects, a user may wish to include several different patterns and therefore may wish to use several different scissors tools. However, utilizing several different scissors tools may be cumbersome, and the user may have difficulty organizing, storing, transporting, or finding such different scissors tools.

It is therefore desirous to provide a cutting tool that permits a user to easily and quickly attain and create different cutting patterns.

BRIEF SUMMARY OF THE INVENTION

In one aspect of the present invention, a cutting tool is provided having a body and first and second scissors tools coupled with the body. The first scissors tool includes a first pair of blades cooperating to define a first cutting pattern and the second scissors tool includes a second pair of blades cooperating to define a second cutting pattern.

In one aspect, each of the first and second scissors tools is pivotally coupled with the body so as to define a stored position and an operational position. The body defines a periphery and the first and second scissors tools are positioned substantially completely within the periphery of the body when in the stored position.

In another aspect, each of the first and second scissors tools includes a protrusion that extends beyond the periphery of the body when the first and second scissors tools are in the stored position such that a user is able to grip the protrusion and move the scissors tools from the stored position to the operational position.

In yet another aspect, the first and second scissors tools each include a first arm pivotally coupled with the body and a second arm pivotally connected to the first arm so as to define an open position and a closed position of the scissors tool. Each of the first and second scissors tools includes a spring urging the first and second arms into the open position. The first and second arms are in the closed position when the scissors tools are in the stored position and are urged towards the open position when the scissors tools are in the operational position.

In another aspect, the first cutting pattern is a pinking pattern and the second cutting pattern is a straight pattern.

In yet another aspect, the cutting tool includes third, fourth, fifth, and sixth scissors tools each coupled with the body and having third, fourth, fifth, and sixth pairs of blades cooperating to define third, fourth, fifth, and sixth cutting patterns, respectively. The third, fourth, fifth, and sixth cutting patterns may include a square wave pattern, a wave pattern, a scallop pattern, a pillows pattern, or any other suitable cutting pattern.

Further objects, features, and advantages of the present invention will become apparent from consideration of the following description and the appended claims when taken in connection with the accompanying drawings.

DETAILED DESCRIPTION OF THE INVENTION

Figure 1:
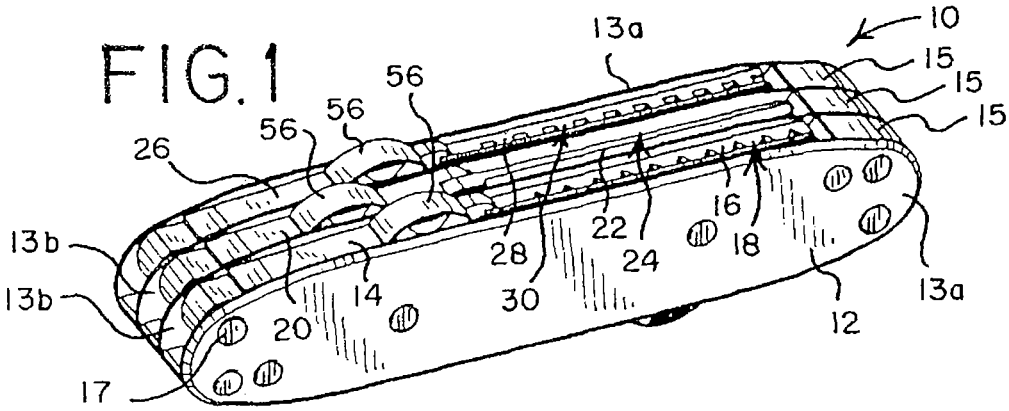
FIG. 1 is a perspective view of a cutting tool embodying the principles of the present invention.
Figure 2:
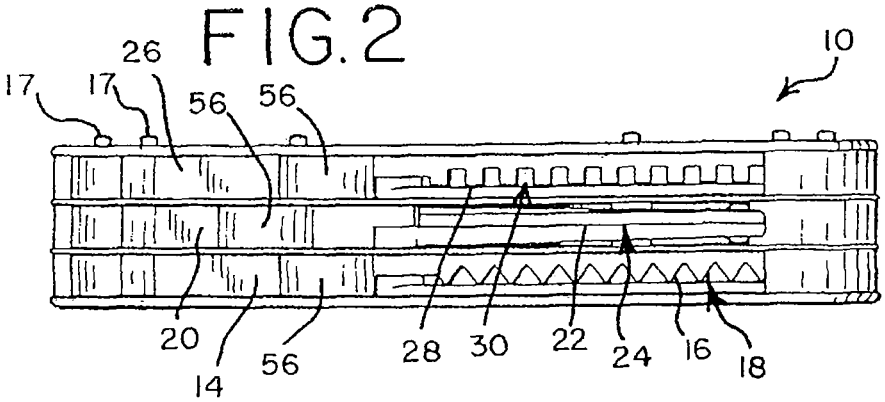
FIG. 2 is a top view of the cutting tool shown in FIG. 1, showing first, second, and third scissors tools.
Figure 3:
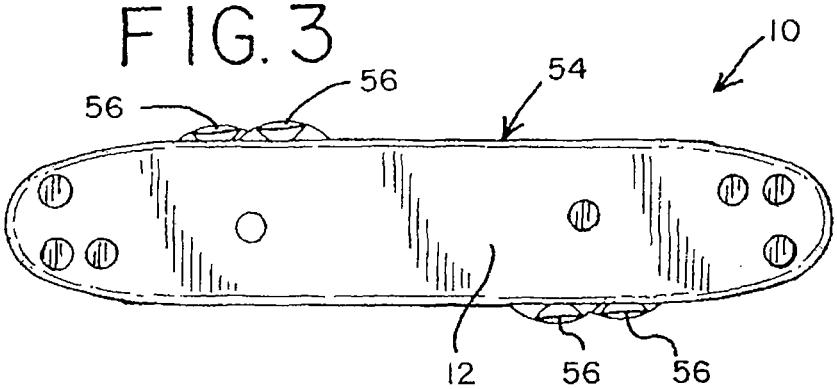
FIG. 3 is a first side view of the cutting tool shown in FIG. 1.
Figure 4:
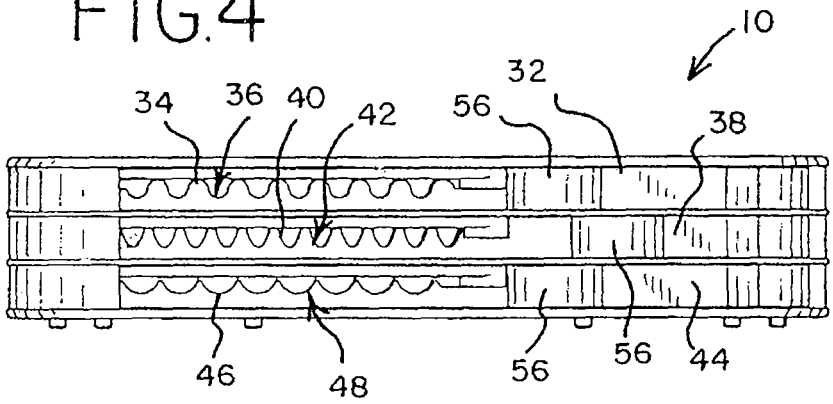
FIG. 4 is a bottom view of the cutting tool shown in FIG. 1, showing fourth, fifth, and sixth scissors tools.
Figure 5:
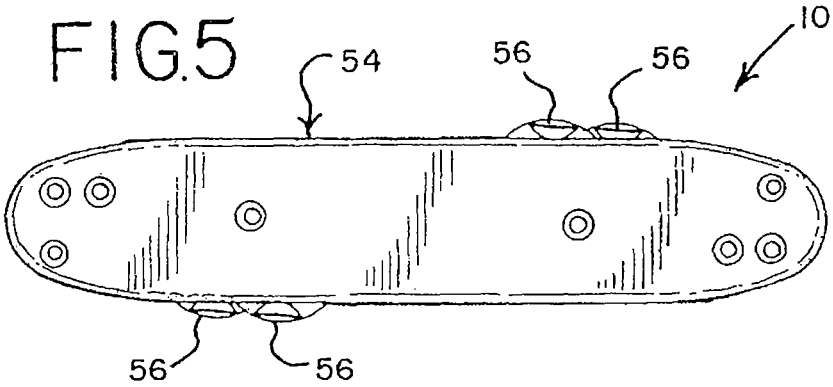
FIG. 5 is a second side view of the cutting tool shown in FIG. 1.
Figure 6:
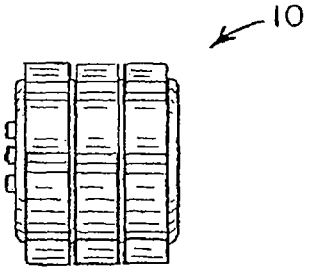
FIG. 6 is a first end view of the cutting tool shown in FIG. 1.
Figure 7:
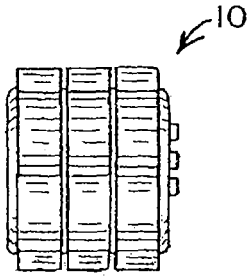
FIG. 7 is a second end view of the cutting tool shown in FIG. 1.
Figure 8:
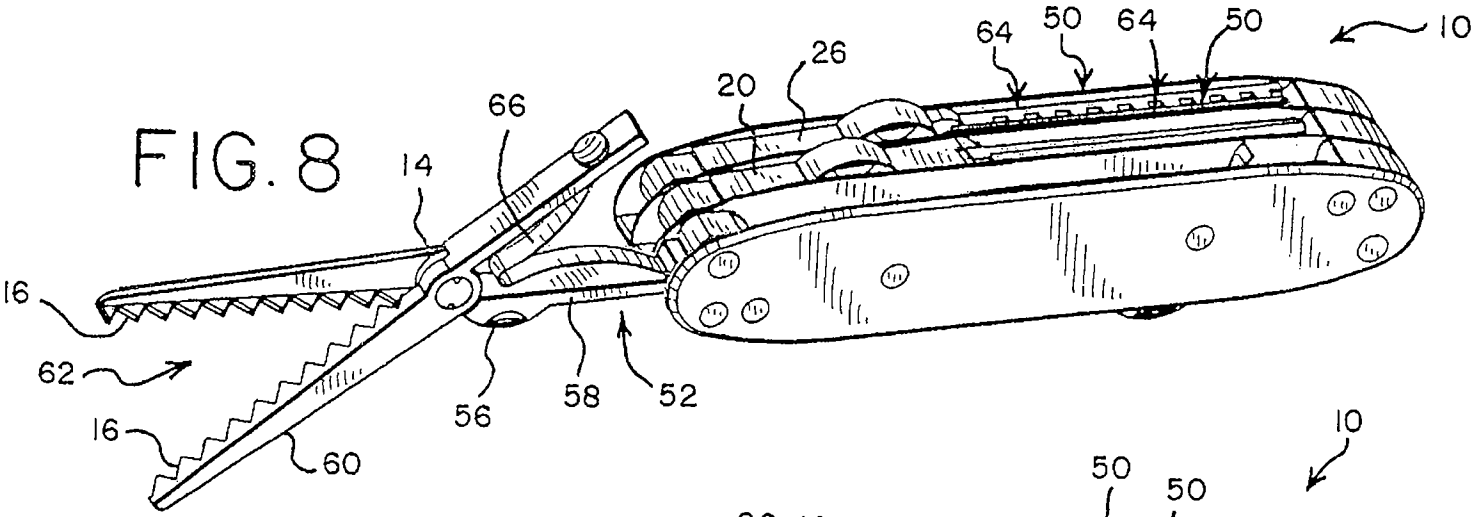
FIG. 8 is a perspective view of the cutting tool shown in FIG. 1, where the first scissors tool, which defines a pinking cutting pattern, is shown in an operational position and the remaining scissors tools are shown in a stored position.
Figure 9:
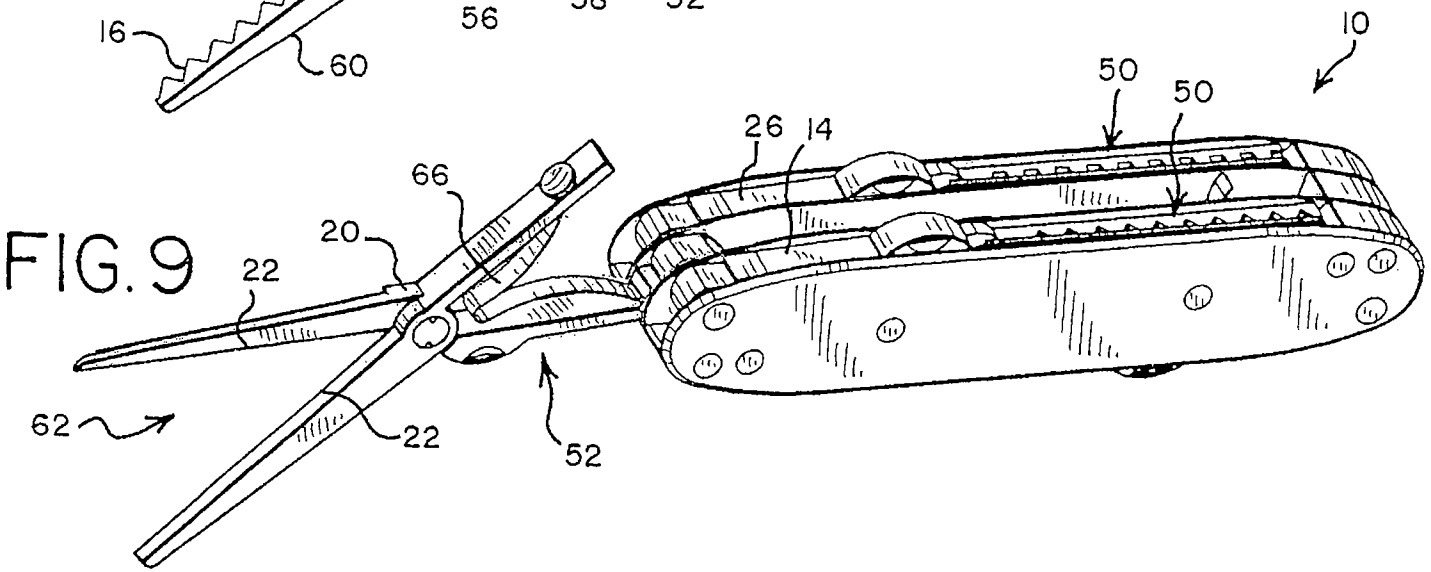
FIG. 9 is a perspective view of the cutting tool shown in FIG. 1, where the second scissors tool, which defines a straight cutting pattern, is shown in the operational position and the remaining scissors tools are shown in the stored position.
Figure 10:
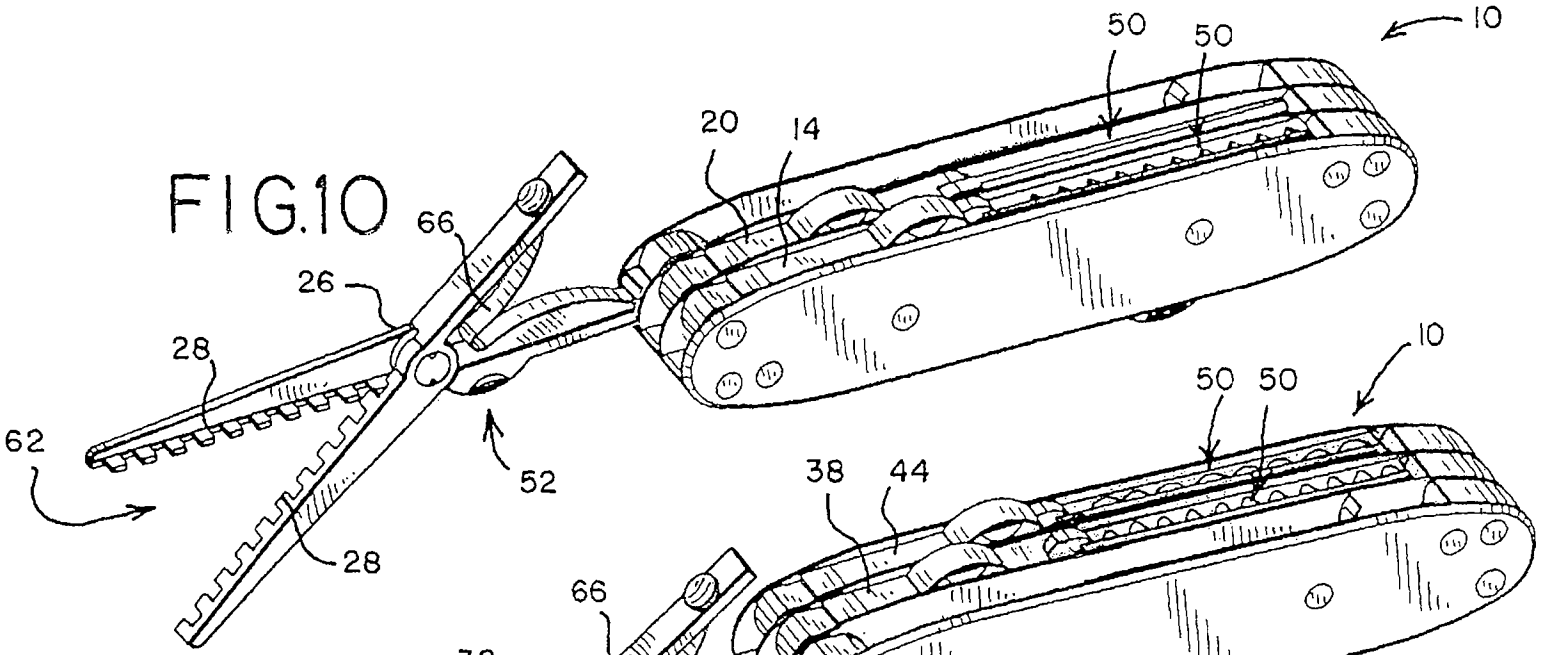
FIG. 10 is a perspective view of the cutting tool shown in FIG. 1, where the third scissors tool, which defines a square wave cutting pattern, is shown in the operational position and the remaining scissors tools are shown in the stored position.
Figure 11:
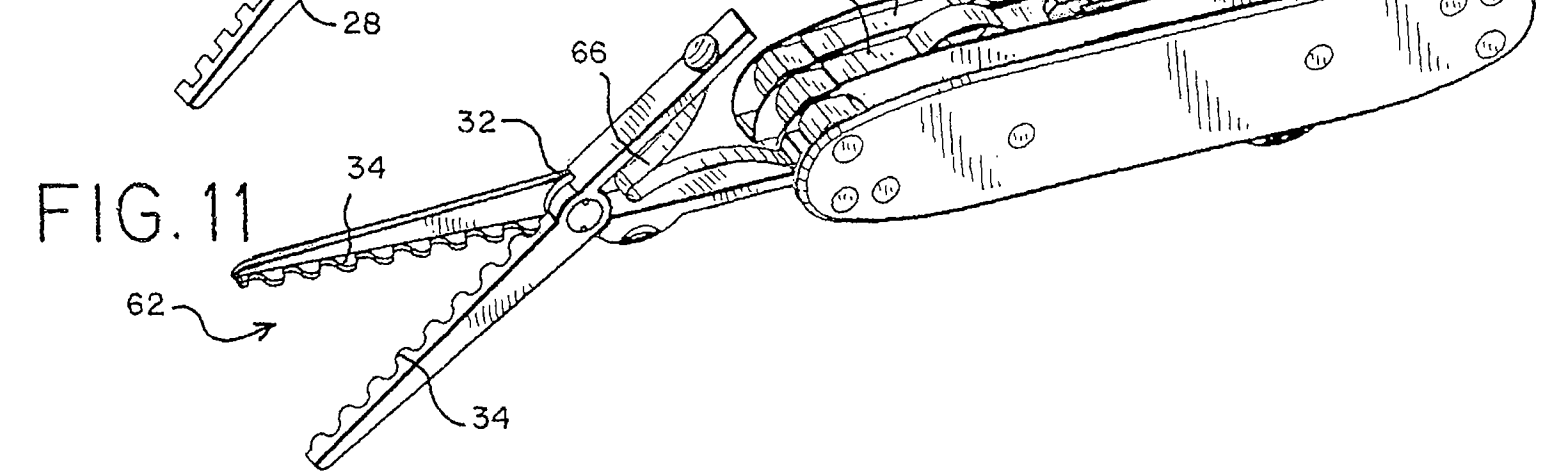
FIG. 11 is a perspective view of the cutting tool shown in FIG. 1, where the fourth scissors tool, which defines a wave cutting pattern, is shown in the operational position and the remaining scissors tools are shown in the stored position.
Figure 12:
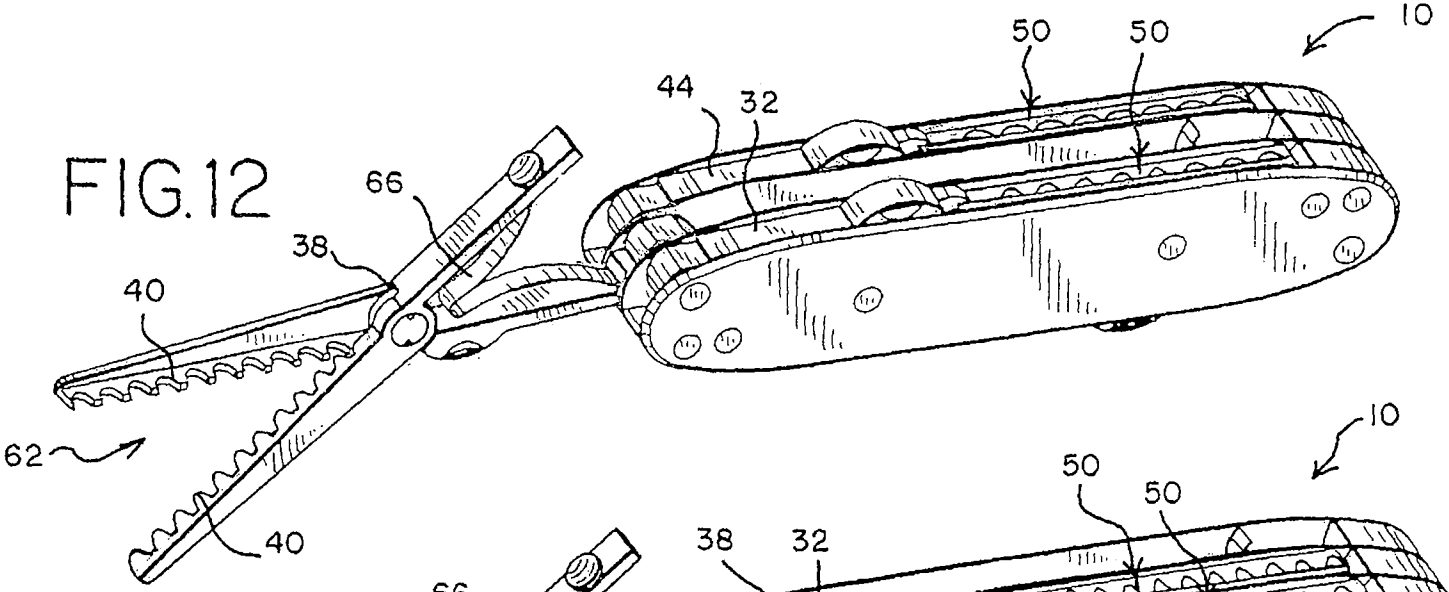
FIG. 12 is a perspective view of the cutting tool shown in FIG. 1, where the fifth scissors tool, which defines a scallop cutting pattern, is shown in the operational position and the remaining scissors tools are shown in the stored position.
Figure 13:
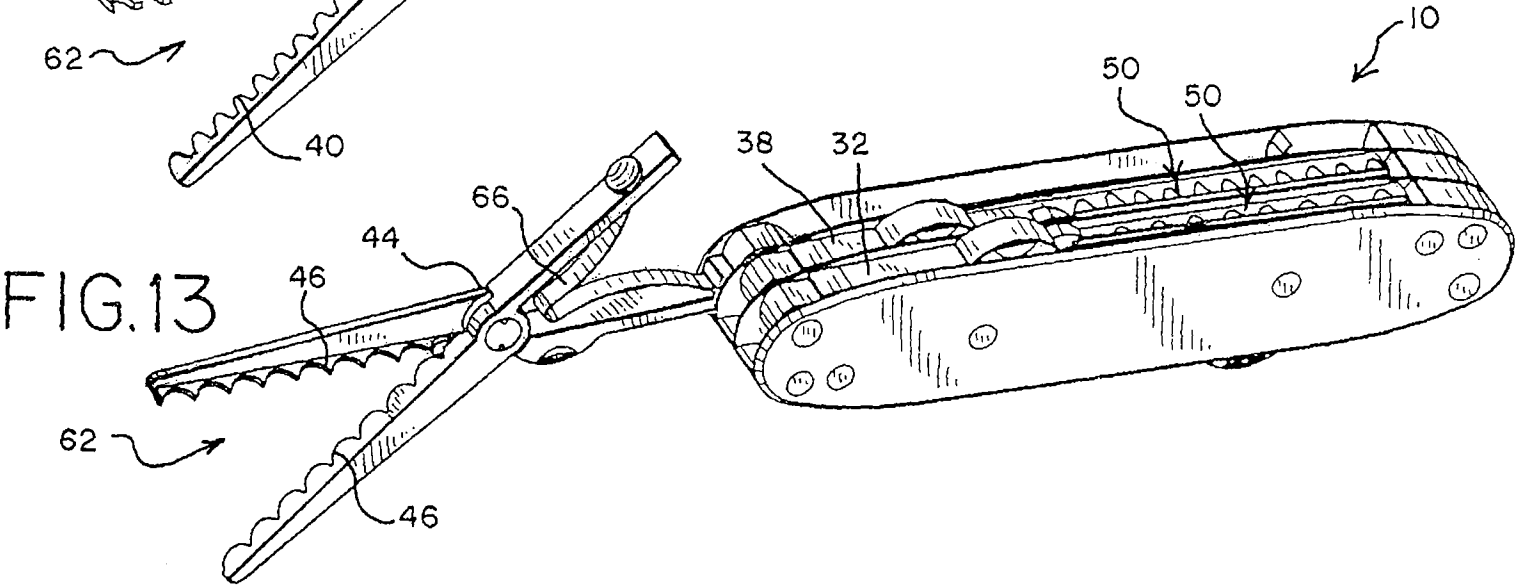
FIG. 13 is a perspective view of the cutting tool shown in FIG. 1, where the sixth scissors tool, which defines a pillows cutting pattern, is shown in the operational position and the remaining scissors tools are shown in the stored position.

Referring now to the present invention, each of FIGS. 1-16 shows a different view of a cutting tool 10 in accordance with the principles of the present invention. The cutting tool 10 includes a body 12 and a plurality of scissors tools, each of which is pivotally coupled with the body 12 and defines a different cutting pattern. For example, the cutting tool 10 shown in the Figures includes: a first scissors tool 14 having a first set of blades 16 defining a pinking cutting pattern 18; a second scissors tool 20 having a second set of blades 22 defining a straight cutting pattern 24; a third scissors tool 26 having a third set of blades 28 defining a square wave cutting pattern 30; a fourth scissors tool 32 having a fourth set of blades 34 defining a wave cutting pattern 36; a fifth scissors tool 38 having a fifth set of blades 40 defining a scallop cutting pattern 42; and a sixth scissors tool 44 having a sixth set of blades 46 defining a pillows cutting pattern 48.

The body 12 includes two side panels 13*a* and two divider panels 13*b* positioned between the side panels 13*a*. The side panels 13*a* and divider panels 13*b* are spaced apart from each other by spacers 15. The side panels, divider panels 13*b*, and scissors tools 14, 20, 26, 32, 38, 44 are coupled together by fasteners such as pins 17. More specifically, the pins 17 extend through a base portion of each of the scissors tools 14, 20, 26, 32, 38, 44 so that the scissors tools 14, 20, 26, 32, 38, 44 are able to pivotally move with respect to the body 12 between a stored position 50 (FIGS. 8-13) and an operational position 52 (FIGS. 8-13). Each of the spacers 15 preferably has a thickness approximately equal to or larger than the thickness of the scissors tools 14, 20, 26, 32, 38, 44 so that the scissors tools 14, 20, 26, 32, 38, 44 are able to pivotally without being obstructed by the side panels 13*a* or the divider panels 13*b*. In addition to the pins 17 pivotally coupling the scissors tools 14, 20, 26, 32, 38, 44 to the body 12, the body 12 also includes additional pins 17 that secure together the components of the body 12.

As mentioned above and as best shown in FIGS. 8-13, the scissors tools 14, 20, 26, 32, 38, 44 are pivotally movable between the stored position 50 and the operational position 52. The side panels 13*a* define a periphery 54 of the body 12. When the scissors tools 14, 20, 26, 32, 38, 44 are in the stored position 50 they are positioned substantially completely within the periphery 54 of the body 12 such that the cutting tool 10 is relatively compact and/or easy to carry or store. However, the scissors tools 14, 20, 26, 32, 38, 44 each include a protrusion 56 that extends beyond the periphery 54 of the body 12 when the scissors tools 14, 20, 26, 32, 38, 44 are in the stored position 50 so that a user is able to grip the protrusion 54 and move the scissors tools 14, 20, 26, 32, 38, 44 from the stored position 50 to the operational position 52. When the scissors tools 14, 20, 26, 32, 38, 44 are in the operational position 52 they are positioned substantially outside of the periphery 54 of the body 12 so that they can be used for cutting or shearing, as is discussed in more detail below. The protrusions 56 shown in the Figures include an indentation to improve the grip thereof. Alternatively, the protrusions 56 may include openings or other features that improve the grip of the protrusions 56.

The scissors tools 14, 20, 26, 32, 38, 44 each include a first pivot arm 58 that is pivotally coupled with the body 12 via the pins 17 and a second arm 60 that is pivotally connected to the first arm 58 so as to define the sets of blades 16, 22, 28, 34, 46. Because the first and second arms 58, 60 are pivotally coupled with each other, they define an open position 62 (FIGS. 8-13) where the two pivot arms are spaced apart from each other and a closed position 64 (FIGS. 8-13) where the two pivot arms engage each other substantially completely along their lengths. During cutting or shearing, the object to be cut (such as paper) is inserted between the arms 58, 60 when they are in the open position 62. The object is then cut when the arms 58, 60 are moved into the closed position 64. The object is cut with a pattern corresponding to the cutting pattern 18, 24, 30, 36, 42, 48 of the sets of blades 16, 22, 28, 34, 46.

The scissors tools 14, 20, 26, 32, 38, 44 also each include a spring 66 urging the arms 58, 60 into the open position 62. Thus, the scissors arms 58, 60 are urged towards the open position 62 when the scissors tools 14, 20, 26, 32, 38, 44 are in the operational position 52. Although the arms 58, 60 are shown in the open position 62 in the Figures when the scissors tools 14, 20, 26, 32, 38, 44 are in the operational position 52, they are able to move between the open and closed positions 62, 64 while the scissors tools 14, 20, 26, 32, 38, 44 are in the operational position 52. Conversely, when the scissors tools 14, 20, 26, 32, 38, 44 are in the stored position 50, the arms 58, 60 are urged into the closed position 64

Figure 14:
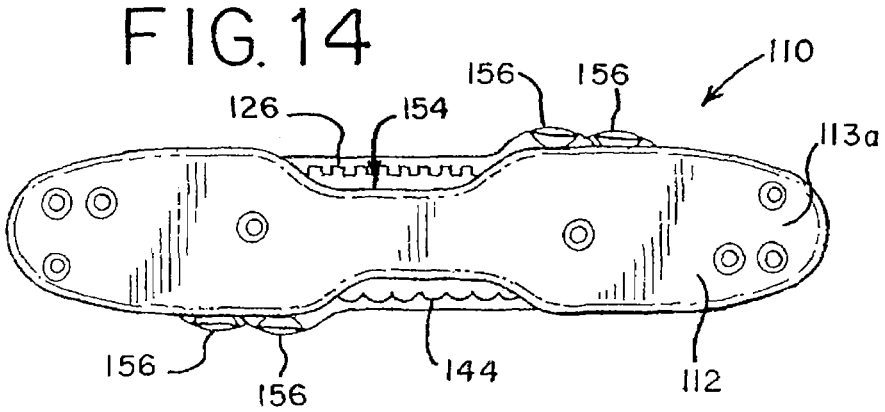
FIG. 14 is a side view of a second embodiment of a cutting tool embodying the principles of the present invention.

Turning now to FIG. 14, a second embodiment of a cutting tool 110 embodying principles of the present invention is shown. The cutting tool 110 includes a body 112 and a plurality of scissors tools, each of which is pivotally coupled with the body 112 and defines a different cutting pattern. The body 112 includes two side panels 113*a* and two divider panels positioned between the side panels 113*a*. The side panels 113*a* and divider panels are spaced apart from each other by spacers. The side panels 113*a* define curved portions 154 to improve the gripability of the cutting tool 110. For example, the curved portions 154 shown in FIG. 14 each have a shape such as to conform to a user's hand, fingers, or thumbs. The curved portions 154 also to provide access to the cutting tools, such as the third scissors tool 126 and the sixth scissors tool 144 shown in FIG. 14, so that they user is able to more easily open the cutting tools into an operational position.

Figure 15:
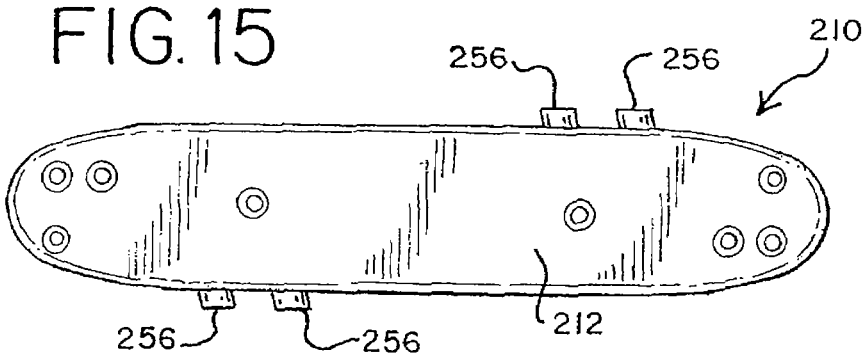
FIG. 15 is a side view of a third embodiment of a cutting tool embodying the principles of the present invention.

Turning now to FIG. 15, a third embodiment of a cutting tool 210 embodying principles of the present invention is shown. The cutting tool 210 includes a body 212 and a plurality of scissors tools, each of which is pivotally coupled with the body 212 and defines a different cutting pattern. The body 212 also includes a plurality of push buttons 256 that are each coupled with one of the various scissors tools. For example, the push buttons 256 are each coupled with a latching mechanism that holds one of the scissors tools in the stored position (as shown in FIG. 15). When one of the push buttons 256 is depressed, the latching mechanism releases one of the scissors tools and the scissors tool is able to move into the operational position. The scissors tools each may be spring-loaded such that they are biased towards the operational position and are able to open automatically when the corresponding push button 256 is depressed.

Figure 16:
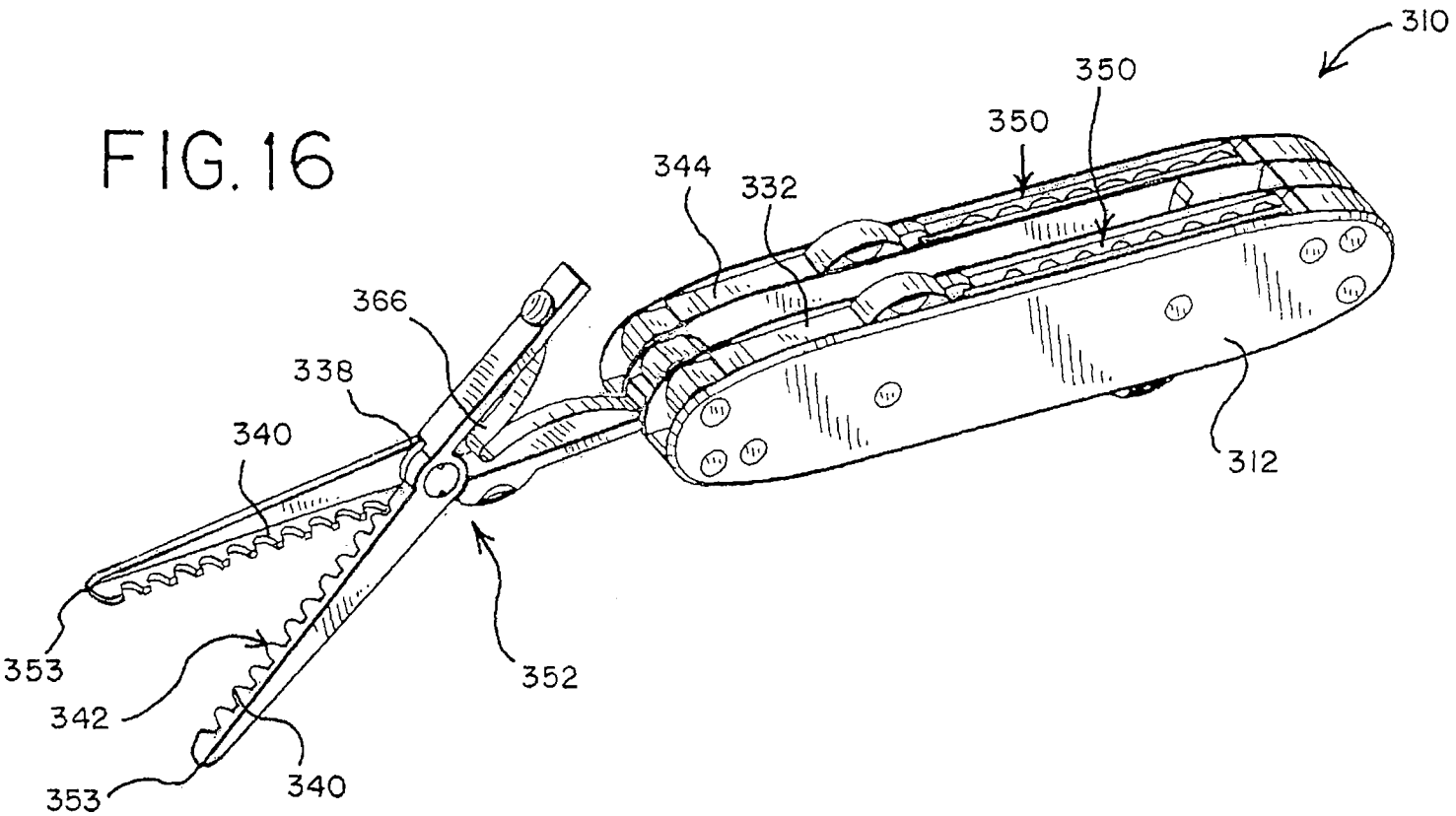
FIG. 16 is a perspective view of a fourth embodiment of a cutting tool embodying the principles of the present invention, where a third scissors tool, which defines a square wave cutting pattern, is shown in the operational position and the remaining scissors tools are shown in a stored position.

Turning now to FIG. 16, a fourth embodiment of a cutting tool 310 embodying principles of the present invention is shown. The cutting tool 310 includes a body 312 and a plurality of scissors tools, each of which is pivotally coupled with the body 312 and defines a different cutting pattern. The scissors tools 332, 338, 344 are able to move between the stored position 350 and the operational position 352. The scissors tools 332, 338, 344 each include a set of blades define a cutting pattern, such as the fifth set of blades 340 defining a scallop cutting pattern 342. The scissors tools 332, 338, 344 also each include a spring 366 urging the arms into the open position. Each of the sets of blades, such as the fifth set of blades 340, includes a rounded tip 353 to potentially reduce the risk of puncturing a work surface or a user with the tips of the blades.

Figure 17:
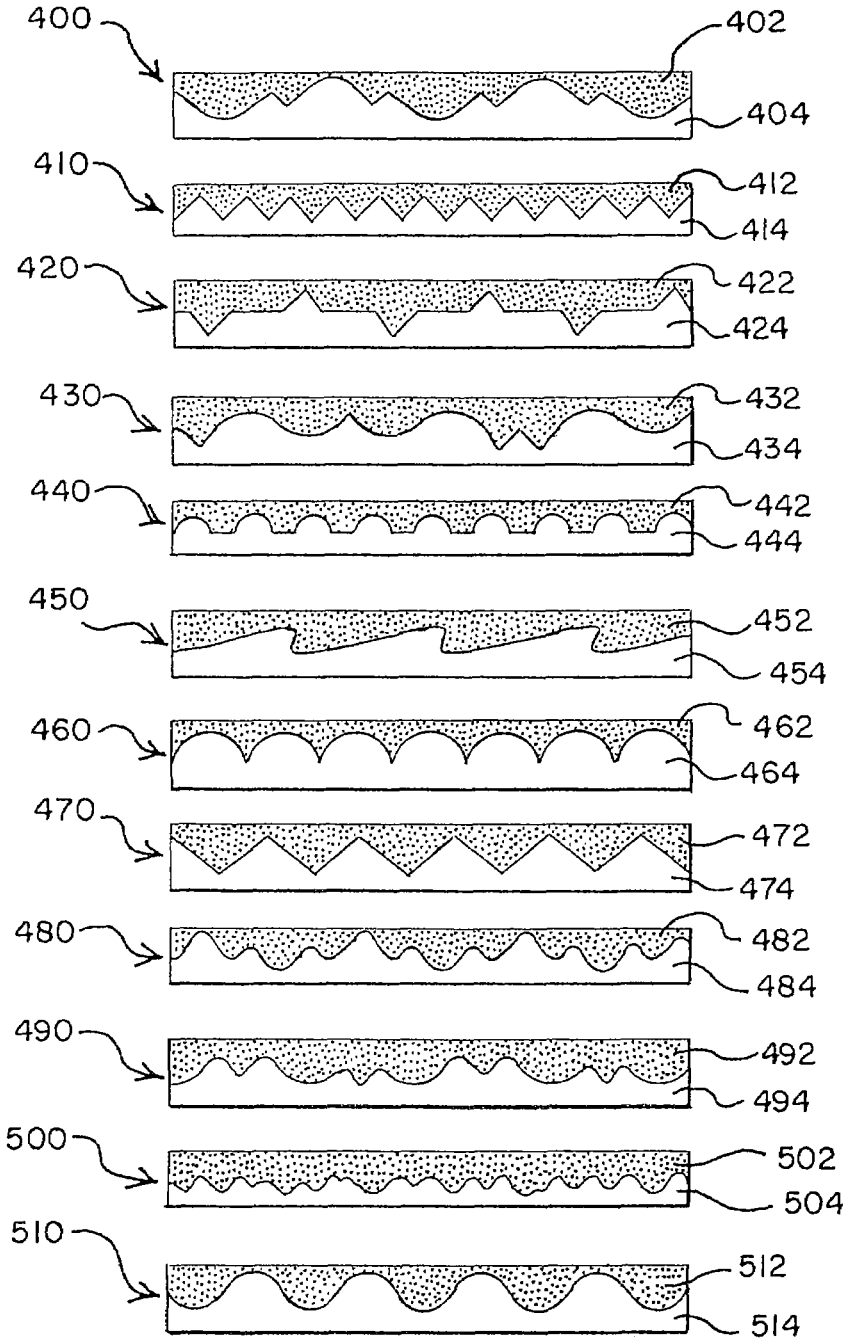
FIG. 17 depicts cutting blades defining varying cutting patterns and embodying principles of the present invention.

Alternative embodiments of the cutting tool may include a varying number of scissors tools, such as fewer or more than the six scissors tools shown in the Figures. Additionally, alternative embodiments of the cutting tool may include scissors tools with blades that define cutting patterns other than those shown in the Figures. For example, FIG. 17 depicts cutting blades defining varying cutting patterns and embodying principles of the present invention. Cutting blade 400 includes a first cutting blade (shaded for illustrative purposes) 402 and a second cutting blade 404 that cooperate to define a seventh cutting pattern. Cutting blade 410 includes a first cutting blade (shaded for illustrative purposes) 412 and a second cutting blade 414 that cooperate to define an eighth cutting pattern. Cutting blade 420 includes a first cutting blade (shaded for illustrative purposes) 422 and a second cutting blade 424 that cooperate to define a ninth cutting pattern. Cutting blade 430 includes a first cutting blade (shaded for illustrative purposes) 432 and a second cutting blade 434 that cooperate to define a tenth cutting pattern. Cutting blade 440 includes a first cutting blade (shaded for illustrative purposes) 442 and a second cutting blade 444 that cooperate to define an eleventh cutting pattern. Cutting blade 450 includes a first cutting blade (shaded for illustrative purposes) 452 and a second cutting blade 454 that cooperate to define a twelfth cutting pattern. Cutting blade 460 includes a first cutting blade (shaded for illustrative purposes) 462 and a second cutting blade 464 that cooperate to define a thirteenth cutting pattern. Cutting blade 470 includes a first cutting blade (shaded for illustrative purposes) 472 and a second cutting blade 474 that cooperate to define a fourteenth cutting pattern. Cutting blade 480 includes a first cutting blade (shaded for illustrative purposes) 482 and a second cutting blade 484 that cooperate to define a fifteenth cutting pattern. Cutting blade 490 includes a first cutting blade (shaded for illustrative purposes) 492 and a second cutting blade 494 that cooperate to define a sixteenth cutting pattern. Cutting blade 500 includes a first cutting blade (shaded for illustrative purposes) 502 and a second cutting blade 504 that cooperate to define a seventeenth cutting pattern. Cutting blade 510 includes a first cutting blade (shaded for illustrative purposes) 512 and a second cutting blade 514 that cooperate to define an eighteenth cutting pattern.

While the present invention has been described in terms of preferred embodiments, it will be understood, of course, that the invention is not limited thereto since modifications may be made to those skilled in the art, particularly in light of the foregoing teachings.

What is claimed is:

1. A cutting tool having a stored position and an operational position comprising:

a body comprising a first side panel, a second side panel, and at least one fastener connecting the first side panel to the second side panel, the first side panel defining a body periphery;

a first scissors tool comprising a first arm pivotally coupled with the body and a second arm pivotally connected to the first arm, the first scissors tool having a first pair of blades cooperating to define a first cutting pattern; and a second scissors tool comprising a first arm pivotally coupled with the body and a second arm pivotally connected to the first arm, the second scissors tool having a second pair of blades cooperating to define a second cutting pattern different from the first cutting pattern;

wherein when the cutting tool is in the stored position, the first scissors tool and the second scissors tool are positioned substantially completely within the body periphery; and wherein when the cutting tool is in the operational position, a scissors tool is positioned substantially outside of the body periphery, the first arm of said scissors tool having been pivoted from the body.

2. A cutting tool as in claim 1, wherein the each of the first and second scissors tools includes a protrusion that extends beyond the periphery of the body when the first and second scissors tools are in the stored position such that a user is able to grip the protrusion.

3. A cutting tool as in claim 1, wherein each of the first and second scissors tools includes a first arm pivotally coupled with the body and a second arm pivotally connected to the first arm so as to define an open position and a closed position of the scissors tool.

4. A cutting tool as in claim 3, wherein each of the first and second scissors tools includes a spring urging the first and second arms into the open position.

5. A cutting tool as in claim 1, further comprising a third scissors tool coupled with the body and having a third pair of blades cooperating to define a third cutting pattern.

6. A cutting tool as in claim 5, wherein the first cutting pattern is a pinking pattern, the second cutting pattern is a straight pattern, and the third cutting pattern is a square wave pattern.

7. A cutting tool as in claim 5, further comprising:

a fourth scissors tool coupled with the body and having a fourth pair of blades cooperating to define a fourth cutting pattern;

a fifth scissors tool coupled with the body and having a fifth pair of blades cooperating to define a fifth cutting pattern; and a sixth scissors tool coupled with the body and having a sixth pair of blades cooperating to define a sixth cutting pattern.

8. A cutting tool as in claim 7, wherein the fourth cutting pattern is a wave pattern, the fifth cutting pattern is a scallop pattern, and the sixth cutting pattern is a pillows pattern.

9. A cutting tool as in claim 7, wherein the body defines a periphery and the first, second, third, fourth, fifth, and sixth scissors tools are positioned substantially completely within the periphery of the body when in the stored position.

10. A cutting tool as in claim 9, wherein the each of the first, second, third, fourth, fifth, and sixth scissors tools includes a protrusion that extends beyond the periphery of the body when the first, second, third, fourth, fifth, and sixth scissors tools are in the stored position such that a user is able to grip the protrusion.

11. A cutting tool as in claim 10, wherein each of the first, second, third, fourth, fifth, and sixth scissors tools includes a first arm pivotally coupled with the body and a second arm pivotally connected to the first arm so as to define an open position and a closed position.

12. A cutting tool as in claim 11, wherein each of the first, second, third, fourth, fifth, and sixth scissors tools includes a spring urging the first and second arms into the open position.

* * * * *